US007017778B2

(12) United States Patent
Halbherr

(10) Patent No.: US 7,017,778 B2
(45) Date of Patent: Mar. 28, 2006

(54) DISPLAY DISPENSER

(75) Inventor: Michael S. Halbherr, Indianapolis, IN (US)

(73) Assignee: Solo Cup Operating Corporation, Highland Park, IL (US)

( * ) Notice: Subject to any disclaimer, the term of this patent is extended or adjusted under 35 U.S.C. 154(b) by 217 days.

(21) Appl. No.: 10/672,951

(22) Filed: Sep. 26, 2003

(65) Prior Publication Data

US 2005/0067429 A1 Mar. 31, 2005

(51) Int. Cl.
*B65H 1/00* (2006.01)

(52) U.S. Cl. ..... 221/34; 211/59.3

(58) Field of Classification Search ..... 312/50, 312/61, 71, 35, 42; 211/184, 59.3, 43; 221/92, 221/279, 56, 34, 33

See application file for complete search history.

(56) References Cited

U.S. PATENT DOCUMENTS

| | | | | |
|---|---|---|---|---|
| 4,020,946 | A | 5/1977 | Gardner et al. | |
| 4,071,139 | A * | 1/1978 | Pernicano et al. | 206/216 |
| 4,364,481 | A | 12/1982 | Ricci | |
| 4,706,821 | A | 11/1987 | Kohls et al. | |
| 4,923,070 | A | 5/1990 | Jackle et al. | |
| 5,024,336 | A | 6/1991 | Spamer | |
| 5,111,942 | A | 5/1992 | Bernardin | |
| 5,123,551 | A | 6/1992 | King | |
| 5,190,186 | A | 3/1993 | Yablans et al. | |
| 5,203,463 | A | 4/1993 | Gold | |
| 5,265,738 | A | 11/1993 | Yablans et al. | |
| 5,542,552 | A | 8/1996 | Yablans et al. | |
| 5,806,690 | A * | 9/1998 | Johnson et al. | 211/59.3 |
| 5,881,910 | A * | 3/1999 | Rein | 221/6 |
| 5,992,652 | A | 11/1999 | Springs | |
| 5,992,653 | A | 11/1999 | Anderson et al. | |
| 6,409,027 | B1 | 6/2002 | Chang et al. | |

* cited by examiner

*Primary Examiner*—Kenneth Noland
(74) *Attorney, Agent, or Firm*—Wallenstein Wagner & Rockey, Ltd.

(57) ABSTRACT

The present invention pertains to a display dispenser having a disposable molded tray with a thin shell, unibody construction that firmly receives a removable pusher assembly. The tray is formed from a unitary sheet of plastic that forms inner and outer shells. Each shell forms the inside or outside half of a continuous wall around the perimeter of the tray. The two wall halves are integrally joined along a top portion, but otherwise spaced apart to provide a double-walled construction. Each wall has a frustoconical shape so that the trays nest into each other when stacked. The inner shell has an interior portion with two symmetrical side ledges that support and align the sides of the packages. The top of the package faces forward to show the artistic design on the article such as the paper plates or paper napkins inside. The inner shell has a central recess that snuggly receives the unified pusher assembly. A rim extending from the wall and a floor of the recess lay flat on a surface of a shelf.

6 Claims, 11 Drawing Sheets

DISPLAY DISPENSER

TECHNICAL FIELD OF THE INVENTION

The present invention relates to a display dispenser with a disposable, thin shell, unibody tray and a separate, unified, snap-in pusher assembly, and is particularly suited for displaying and dispensing an assortment of packaged products in an organized and shoppable manner while accommodating ever changing shelving area requirements.

BACKGROUND OF THE INVENTION

Display dispensers are commonly used in retail and grocery store settings to organize items on store shelves and move those items forward toward the front of the shelf so that customers can easily see and reach the item. Each display dispenser contains a certain type of product, such as a bottle or box of pills. The product is placed in an upright position on the display, preferably with its label facing forward so that the customer can more readily identify the product. Items are placed on the display in a column. When the frontmost item is removed, the display causes the column of items to move forward toward the front of the display so that the next item in the column becomes the frontmost item. The display dispenser can be sloped forward so that the items slide forward under their own weight toward the front of the display, or the display dispenser can include a pusher mechanism to push the products forward.

Gravity fed display dispensers rely on the weight of the item to move it forward. These displays are frequently used for heavier or denser products. The product is contained in a relatively rigid container with a smooth bottom surface such as cans of soda, gallons of milk or bottles of pills. The rear end of the dispenser is elevated so that its supporting bottom surface slopes forward. The dispenser can include a tray supported by a rack that angles the tray forward. The weight of the item produces enough forward force to overcome its friction with the tray and allow the item to slide forward. A conventional gravity fed display dispenser is shown and described in U.S. Pat. No. 4,923,070 the disclosure of which is incorporated by reference.

Display dispensers with push mechanisms are typically designed for lighter weight items that can be easily moved along a horizontal surface with relatively little force. The displays are robustly designed for repeated use. When the item being sold is depleted, the display is refilled. The tray is typically made of plastic and has a multi-piece construction to form its walls and bottom or support surface. The walls of the display are formed by solid planks or plates of relatively thick material such as plastic. The bottom surface has a similar solid construction. The display dispensers typically have a complex construction to allow them to be assembled to hold a variety of different product shapes and sizes. The pusher mechanism is integrally molded to the walls or bottom of the tray or is otherwise difficult to separate and remove from the tray. Examples of conventional dispensers are shown and described in U.S. Pat. Nos. 6,409,027; 5,992,653; 5,542,552; 5,265,738; 5,203,463; 5,190,186; 5,111,942 and 5,024,336, the disclosures of which are incorporated by reference herein.

A problem with conventional display dispensers is that they are not readily adapted to handle an assortment of products that have fluctuating shelving space requirements. The displays have a multitude of component parts that have to be constantly assembled and disassembled to handle an assortment of differently shaped products and meet ever changing shelving space requirements of seasonal and holiday products such as paper plates and paper napkins. Shelving space is in high demand, and displays must be able to accommodate changes in shelving space requirements when a variety of different artistic designs are made available to consumers, as well as changes in shelving space demand due to periods of high or low sales volume. Parts that are not currently needed for a smaller variety of products in the display must be removed and stored. If one of the parts is damaged or lost, the entire display dispenser may be rendered of limited use. The staff also needs to learn and relearn how to assembly and disassembly the display, and where the parts are stored and any instruction manuals are kept. Yet, assembling and disassembly the displays during busy holiday seasons is an excessive waist of time and a source of frustration for the staff.

Another problem with conventional display dispensers is that they are unnecessarily robust and expensive. The solid and thick walled construction of the display and its tray is unnecessary for many lighter weight products such as paper plates and paper napkins. The low cost and competitive pricing of these types of products also render it commercially impractical to invest in expensive display dispensers, particularly if the display dispenser is not intended for continual use or reuse. The displays are not designed to readily accommodate frequent changes in sales volumes and artistic patterns, such as adding more shelf area or display area for the holidays or the summer picnicking season. Disposing of these robustly designed, reusable and relatively expensive displays is simply impractical.

A further problem with conventional display dispensers is that they are not intended to display an artistic design on a packaged article, particularly when that design faces the top of the package. Packaged products are typically placed on the dispenser with their top side facing up. When the display is on a shelf of a store above or below eye level, the consumer cannot see the design on the top of the product. Even when the product is placed on its side on the display, the front wall of the display blocks a significant portion of the artistic design so that the customer cannot readily see or understand the design. This is a particular concern for cardboard type display dispensers because consumers cannot see through the front wall of the tray to see the design on the plate or napkin.

A still further problem with conventional display dispensers is that they are not meant to handle an assortment of matching sets of products with similar designs that are intended to be sold together. For example, paper plates are frequently sold in a variety of sizes and with a variety of artistic designs. The smaller plate is intended for salad or desert, while the larger plate is intended for the main meal. Each plate has the same or a complimentary artistic design and is intended to provide a matching set of plates. In addition, a variety of paper napkins are often sold with designs that correspond to the plates. A smaller napkin is for a beverage and a larger napkin is for a dinner setting. Conventional display dispensers are not intended to help arrange an assortment of various matching products, particularly when there are several artistic designs involved. Conventional displays that handle a variety of products have rather bulky, multi-piece trays that are difficult to assemble, adjust and disassemble and are intended for continual use or reuse.

A still further problem with conventional display dispensers is that adjacent trays are interlocked so that there is no easy way to reduce the size of the display or shift a particular product over in the display. When a particular product having a particular design in the middle of the display is depleted, there is no easy way to eliminate that portion of the display and shift the remaining columns of product with other designs over in an organized manner so that the similar products bearing the same artistic design remain in alignment on the shelving. An opening remains in the display where the depleted item was located, or the items become misaligned when each package is manually shifted over. When items are shifted over, the staff has to pick up and move each of the many packaged items in the multi-product display. This can be difficult because the clearance between the tops of the packages on the display and the bottom of the next shelf may not allow the staff to easily reach in and grab all of a particular type of product that is stacked on end on a single track of the display dispenser.

A still further problem with conventional display dispensers is that they are not designed to hold the product during shipping. The restockable displays are shipped in a disassembled form and separate from the product. The multi-piece displays must be assembled and are not ready to use when they are received. The correct quantity of product needs to be ordered, and has to be counted out and stocked on the assembled display when both are received.

A still further problem with conventional display dispensers is that are not stackable in an assembled form during storage and shipping. The displays are relatively large and need to be disassembled before they can be shipped or stored in a reasonably compact manner. The trays do not nest one into the other.

The present invention is intended to solve these and other problems.

BRIEF DESCRIPTION OF THE INVENTION

The present invention pertains to a display dispenser having a disposable molded tray with a thin shell, unibody construction that firmly receives a removable pusher assembly. The tray is formed from a unitary sheet of plastic that forms inner and outer shells. Each shell forms the inside or outside half of a continuous wall around the perimeter of the tray. The two wall halves are integrally joined along a top portion, but otherwise spaced apart to provide a double-walled construction. Each wall has a frustoconical shape so that the trays nest into each other when stacked. The inner shell has an interior portion with two symmetrical side ledges that support and align the sides of the packages. The top of the package faces forward to show the artistic design on the article such as the paper plates or paper napkins inside. The inner shell has a central recess that snuggly receives the unified pusher assembly. A rim extending from the wall and a floor of the recess lay flat on a surface of a shelf.

One advantage of the present display dispenser is that it maximizes shelving space and shoppability. The display dispensers enable a store to modify a shelving area displaying an assortment of items so that that shelving area can accommodate fluctuations in volumes of sales and the number artistic designs being offered. The number of display dispensers can be easily increased or reduced to meet the needs of a particular season or holiday while minimizing shelving space requirements and displaying the items in an organized and shoppable manner. The number of display dispensers in a shelving area can be easily added to or subtracted from to meet ever changing shelving space requirements of seasonal and holiday products such as paper plates and paper napkins. The display dispenser is particularly suited to accommodate changes in shelving space requirements when an assortment of different artistic designs are involved. During periods of low volume or when fewer designs are being displayed, unnecessary displays are simply removed from the shelves. When the volume of sales picks up or when a larger variety of designs are made available, additional trays are added back to the shelves.

Another advantage of the present display dispensers is the disposable nature of the tray. Each display has a tray and a pusher assembly that are easily snap fit together and taken apart. The larger, thin-walled tray can be economically produced for one-time use without significantly increasing the cost to the product it displays. The inexpensive thin shell construction of the tray is particularly suited for supporting and aligning many lighter weight products such as paper plates and paper napkins without the costly and unnecessary waist of materials. The structurally efficient hollow, double walled construction of the tray provides the necessary support for products such as paper plates and paper napkins. The economic advantage of the tray is particularly significant when the tray or the entire display dispenser is only intended to be used a once or a few times before being discarded. The disposable nature of the tray enables the dispenser display to readily accommodate packaged products that have frequent changes in sales volumes and artistic designs or patterns such as paper plates and napkins. A larger volume of product or assortment of designs can be easily incorporated into a shelving unit during the holidays or summer picnicking season. A smaller volume of product or assortment of designs can be easily incorporated into a shelving unit during off-seasons so that the overall shelving area required to display a product line is kept to a minimum. Unused trays can be either stacked and stored for reuse or thrown away. The disposable tray is preferably made of recyclable plastic to minimize any environmental concerns.

A further advantage of the present display dispenser is the stackability of its tray. The frustoconical shape of the double walled construction of the tray allows one tray to nest and stack one atop the other. This dramatically reduces the otherwise large, bulky nature of the trays during shipping or storage. Many trays can be nested into a relatively compact stack.

A still further advantage of the present display dispensers is its integrally removable pusher assembly. The components forming the pusher assembly remain assembled as a single working unit when the pusher assembly is installed in or separated from the tray. The integral pusher assembly is easily snapped into or out of the recess of the tray, and can be saved for further use without being disassembled or reassembled. Even though the size of the trays or the shape of their ledges may differ, each like-shaped pusher assembly fits into the like-shaped recess of any tray. The pusher assembly fits into and is securely received by the recess of a tray for holding packages of larger dinner plates or a tray for holding packages of smaller beverage napkins. As a result, joining the pusher assemblies to or removing them from the trays is a quick and simple task that requires no instruction manual and waist little or no time.

A further advantage of the present display dispenser is that it ability to display the artistic design on packaged articles even when the design is on the top of the package. Packaged products are placed on the dispenser with their top side facing forward. Consumers can easily see the design on the top of the product when the display dispenser is above, at or below eye level. The front wall of the display includes a window to visibly reveal the majority of the artistic design on the package so that the customer can readily understand the design. The tray is also made of transparent plastic so that its thin shell construction enables consumers to more readily see the complete design when it is pressed against the front wall of the tray.

A still further advantage of the present display dispensers is that they line up next to each other but do not interlock. The product is contained within the side margins of the tray so that adjacent trays can abut without causing the product of one tray to jam or otherwise interfere with the dispensing of product from an adjacent tray, even if the products in the adjacent trays are a different size or shape. The dispenser displays can handle an assortment of matching sets of products with similar designs that are intended to be sold together, such as stacks of paper plates and napkins. Plates and napkins with the same or a complimentary artistic design on their top surfaces are displayed and dispensed in a manner that allows customers to easily identify and select matching sets of plates and napkins. Each display dispensers is a separate structure so that the product it contains is easy to move to a different location on a shelf or to a different shelf altogether. When a particular product or design in the middle of the shelf display area is depleted, the display and the product it holds can be easily slide or shifted over on the shelf or picked up and moved in an organized manner so that the similar products bearing the same or corresponding designs remain in alignment on the shelving. The display dispensers can remain in abutting alignment so that the minimum amount of shelf area is needed. Trays of product are moved without disturbing the placement of the product on the tray. The staff does not need to pick up and move each packaged of product to reorganize the shelving display.

A still further advantage of the present display dispensers is that they can hold the product during shipping. Depending on customer preference, packaged product can be shipped with or without the tray or its pusher assembly. When the product is shipped with the display dispenser, the product is set in the tray in a manner similar to when the display is placed on the store shelf. The display dispensers can be shipped with the pusher assembly cocked so that loaded display dispenser is simply removed from a shipping box and placed on a shelf. The display dispenser can also be shipped with the correct amount of product in the tray, but with the pusher assembly uncocked or removed from the tray. In either instance, the display dispensers are ready to use when they are received. The product is sold and shipped in quantities that fit into or fill the tray so that the staff does not have to count out the number of packages for each tray to prevent overfilling or underfilling the dispenser displays or storing any unused product.

Other aspects and advantages of the invention will become apparent upon making reference to the specification, claims and drawings.

DESCRIPTION OF THE PREFERRED EMBODIMENTS

While this invention is susceptible of embodiment in many different forms, the drawings show and the specification describes in detail preferred embodiments of the invention. It should be understood that the drawings and specification are to be considered an exemplification of the principles of the invention. They are not intended to limit the broad aspects of the invention to the embodiments illustrated.

Figure 1:
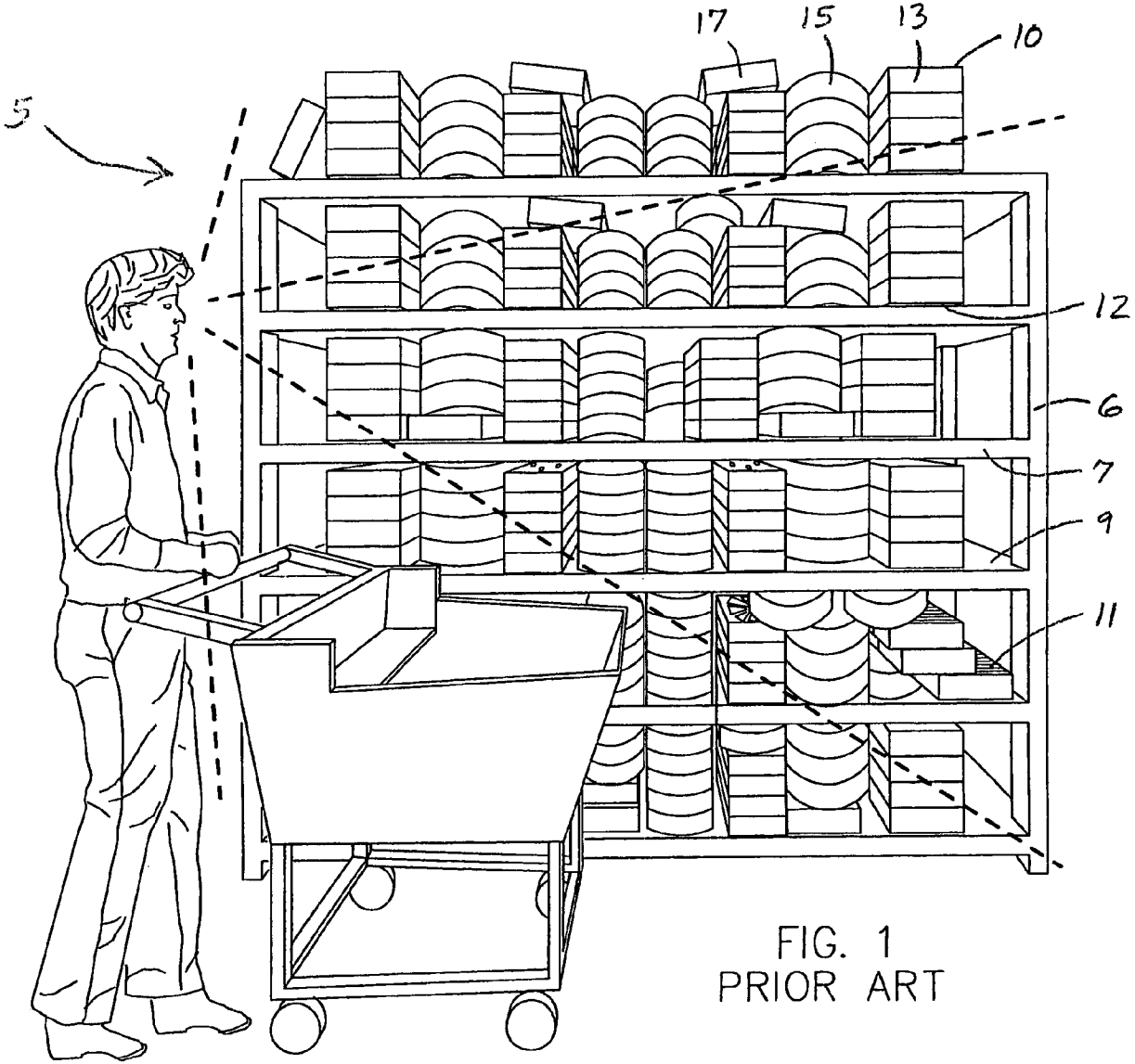
FIG. 1 PRIOR ART
FIG. 1 is a perspective view of a conventional assortment of packages of paper plates and napkins on a shelving unit of a store.

Retail and grocery stores present goods on shelving so that customers can easily move along aisles 5 to shop for articles or items they want to purchase as shown in FIG. 1. Each shelving unit 6 has a number of individual shelves 7 that are set one above the other and spaced apart so that each is at a different height. Each shelf 7 has a substantially flat and typically horizontal upper surface 9 upon which packaged goods 10 are placed. Some stores use shelves 7 that are slightly tilted or sloped toward the aisle 5 so that the products 10 on the upper shelves can be more readily seen by younger or shorter customers. Packaged goods 10 are placed on the shelves 7 so that the customer can see the label and other information they need to make their purchasing decision as they walk along the store aisle 5. The purchasing information includes a description of the product in text or picture form, the mark or brand name for the product, the volume or quantity of items in the package, desirable attributes of the product, etc.

Packaged products 10 have top 11, bottom 12 and side 13 surfaces. Packages 10 are typically designed to be placed on a horizontal surface in an upright position. The bottom surface 12 of the package 10 rests on the upper surface 9 of the shelf 7 with its top surfaces 11 facing up. Purchasing information is located on the side 13 of the product 10 so that customers can see this information when the product is placed in an upright position on a store shelf 7. Packages 10 with round sides 13 such as those using plastic wrap 14 to contain a stack of round paper plates 15 are particularly suited for laying in an upright position because they tend to roll around when placed on their side 13. Similarly, packages 10 of flexible products such as those using plastic wrap 14 to contain a stack of paper napkins 17 are also suited for laying in an upright position because they tend to sag and fall over when placed on their side 13.

Shorter packages 10 with larger upper and lower surfaces 11 and 12 have side surfaces 13 that lack enough area to readily accommodate customer purchasing information in a size that can be seen by customers from a few feet away. These packages 10 have purchasing information on their upper surface 11. Shorter packages 10 are also stacked on top of each other to best utilize the available shelf space. Yet, the top surface 11 of these packaged goods 10 are often difficult to see when the products are placed on the shelves 7 in an upright position. When placed on lower shelves 7, the line of sight of the customer to the top 11 of the product 10 is obstructed by the shelf immediately above, particularly when the top surface is near the above shelf. When placed on higher shelves 7, the top 11 of the product 10 may be above the eye level of the customer, and thus is not in the line of sight of the customer. The depth of the shelving units 6 are usually substantial so that the shelves 7 hold a large quantity of packaged goods 10. The line of sight to the top surface 11 of a product 10 is particularly obstructed when the product is further back on the shelf 7.

Packages 10 of paper plates 15 and paper napkins 17 have a predetermined quantity or number of like-shaped plates or like-shaped napkins. Packaged plates 15 typically have a round shape with the same diameter dimension, and are stacked one atop the other so that their side edges are flush. Dinner plates 15 commonly have a diameter of about 9 inches. Desert plates 15 commonly have a diameter of about 7 inches. Packaged napkins 17 have a square or rectangular shape with the same width dimension, and are stacked one atop the other so that their side edges are flush. Dinner napkins 17 have a width of about 6½ inches. Beverage napkins 17 have a width of about 5 inches. Packages 10 formed by plastic wrap 14 have sides 13 with the same shape as the side edges of the round plates 15 or square napkins 17 they contain. Packages 10 of stacked plates 15 or napkins 17 have a relatively wide diameter or width relative to their height. Paper plates 15 and paper napkins 17 with an artistic design or phrase intended for a special event such as a birthday, holiday, graduation, anniversary or retirement party are typically sold in packages 10 including about 8 to 30 paper plates or napkins. Packages 10 of specialty plates 15 typically have a height of about 7 to 10 inches, and a weight of about 5 to 13 ounces for dinner plates. Packages 10 of specialty napkins 17 typically have a height of about 5 to 9 inches, and a weight of about 2 to 4 ounces for dinner napkins. Paper plates 15 and napkins 17 intended for more generic or all occasion use are typically sold in packages 10 of about 8 to 20 paper plates or napkins. These packages are also shorter in height than the diameter or width of the package. The packages 10 tend to fall over or roll away when placed on their side unless they are supported by a container such as a display dispenser as discussed below. Although the paper plates 15 are shown and described as being round, and the napkins 17 are shown and described as being square or rectangular, it should be obvious that the plates and napkins could have other shapes. For example, the paper plates 15 can have a rectangular shape.

Figure 2:
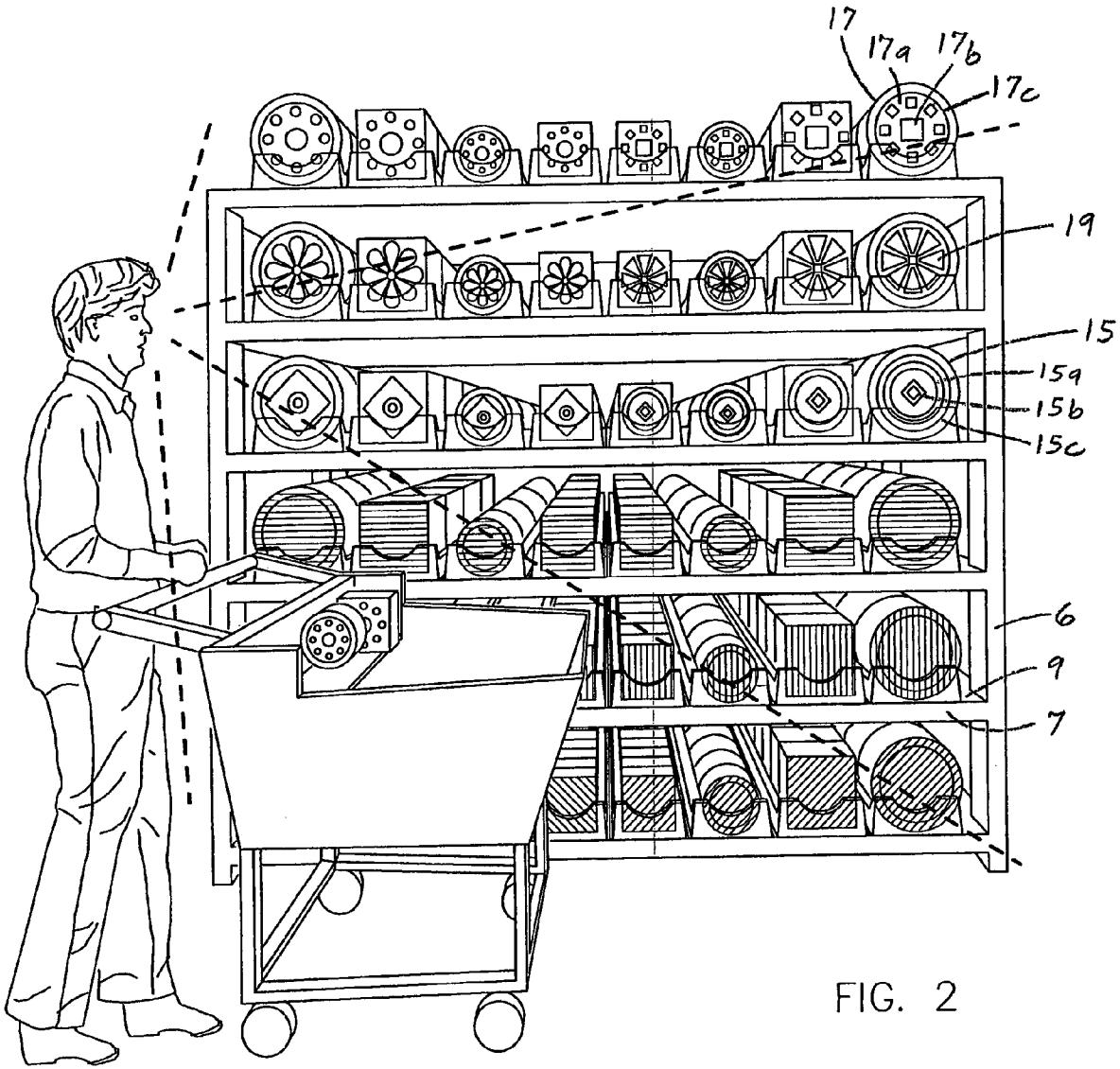
FIG. 2 is a perspective view of several display dispensers arranged on the shelving of a store in an organized, compact and shoppable manner, each display dispenser holding packages of paper plates or paper napkins having a specific color, colors or artistic design, each plate having a matching plate or napkin to form a matched set, and the display dispensers being arranged so that the color or design of the plates and napkins are facing forward and in the line of sight of the customers as they walk by the shelving.

Paper plates 15 and paper napkins 17 are typically packaged and sold in an assortment of colors or artistic designs as shown in FIG. 2. Each plate 15 has a top surface 15*a*, a substantially flat central platter portion 15*b* and a raised rim 15*c*. Each napkin 17 has a top surface 17*a*, a central portion 17*b* and a border area 17*c*. The paper plates 15 or napkins 17 in each package 10 have a specific color or two or more colors that form a visible artistic design 19 on their top surface 15*a* or 17*a*. The design 19 can have a first portion located in the central area 15*b* or 17*b*, and a second portion around its rim 15*c* or border 17*c*. Some packages 10 of plates 15 and napkins 17 have corresponding or matching designs 19. The plates 15 and napkins 17 in these matched sets of packages have the same or a complimentary design 19. The transparent wrapper 14 surrounds the stack and allows the customer to see the colors and design 19 on the surface 15*a* or 17*a* of topmost plate 15 or napkin 17 in the stack. Unfortunately, these packages 10 of stacked plates 15 and napkins 17 are usually placed on the shelf facing up so that the assortment of colors and designs 19 on the top 11 of the packages are not visible to customers when they walk by the shelving 6.

Figure 3A:
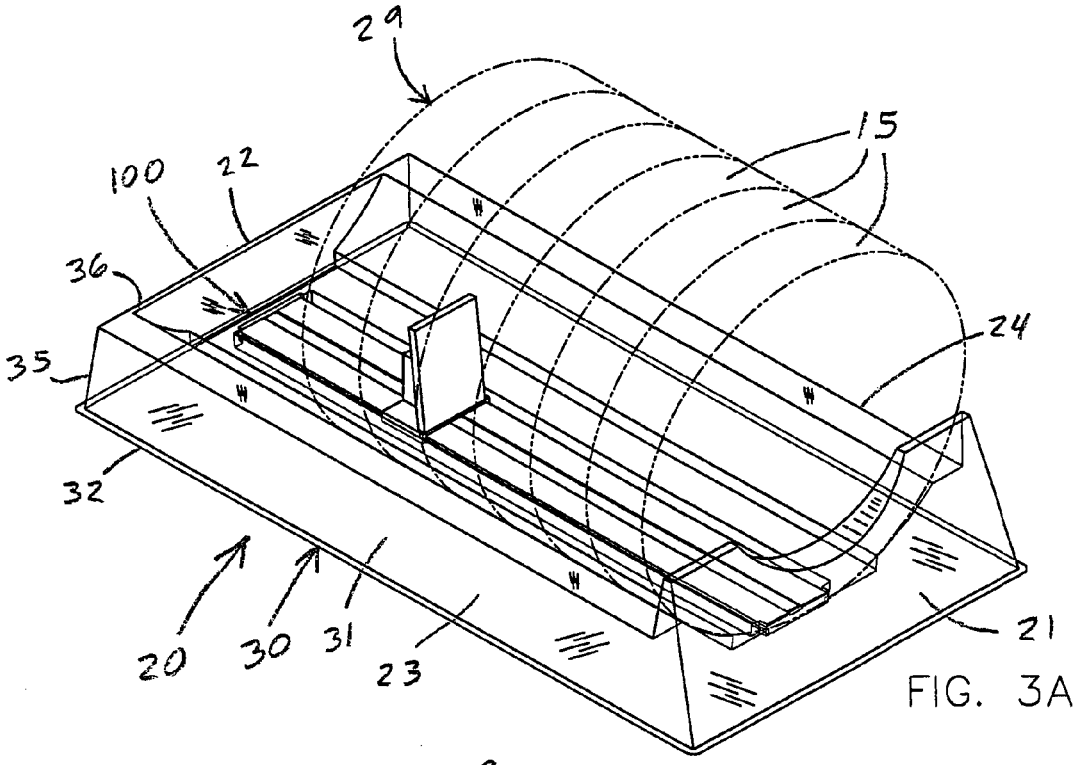
FIG. 3A is a perspective view of a first embodiment of the present display dispenser with a thin shell, unibody tray with a continuous outer double wall construction and arcuate side ledges for holding round paper plate packages and a unified pusher mechanism secured in a recess of the tray for advancing a column of packages toward the front of the tray.
Figure 3B:
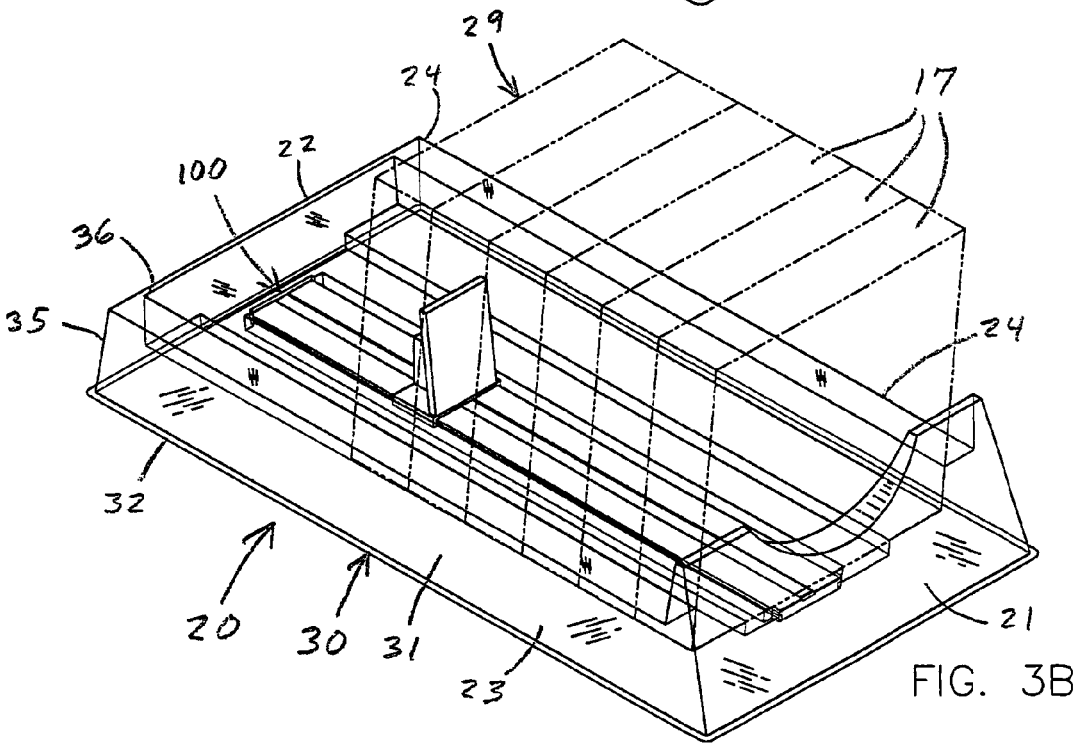
FIG. 3B is a perspective view of a second embodiment of the present display dispenser with a thin shell, unibody tray with squared off side ledges for holding square paper napkins.

The present invention relates to a display dispenser generally shown by reference number 20 in FIGS. 2, 3A and 3B. The display dispenser 20 has a front 21, a rear 22 and sides 23 and 24 that form a generally rectangular shape with four corners when viewed from above. The display 20 is symmetrical about a central vertical plane 28 that extends from the front 21 to the rear 22 of the display. The display dispenser 20 is particularly suited for arranging a number of packages 10 of articles such as stacks of paper plates 15 and paper napkins 17 in a forward facing, flushly aligned or queued arrangement 29 to form a column of packages. The displays 20 can be arranged on the store shelving 6 so that an upper shelf 7 includes packages 10 of paper plates 15 having a variety of designs 19. The lower shelf 7 includes packages 10 of paper napkins 17 having a variety of matching designs 19. The matched sets of packages 10 of paper plates 15 are placed immediately above or below the packages of paper napkins 17 with the same or corresponding design 19.

Figure 4A:
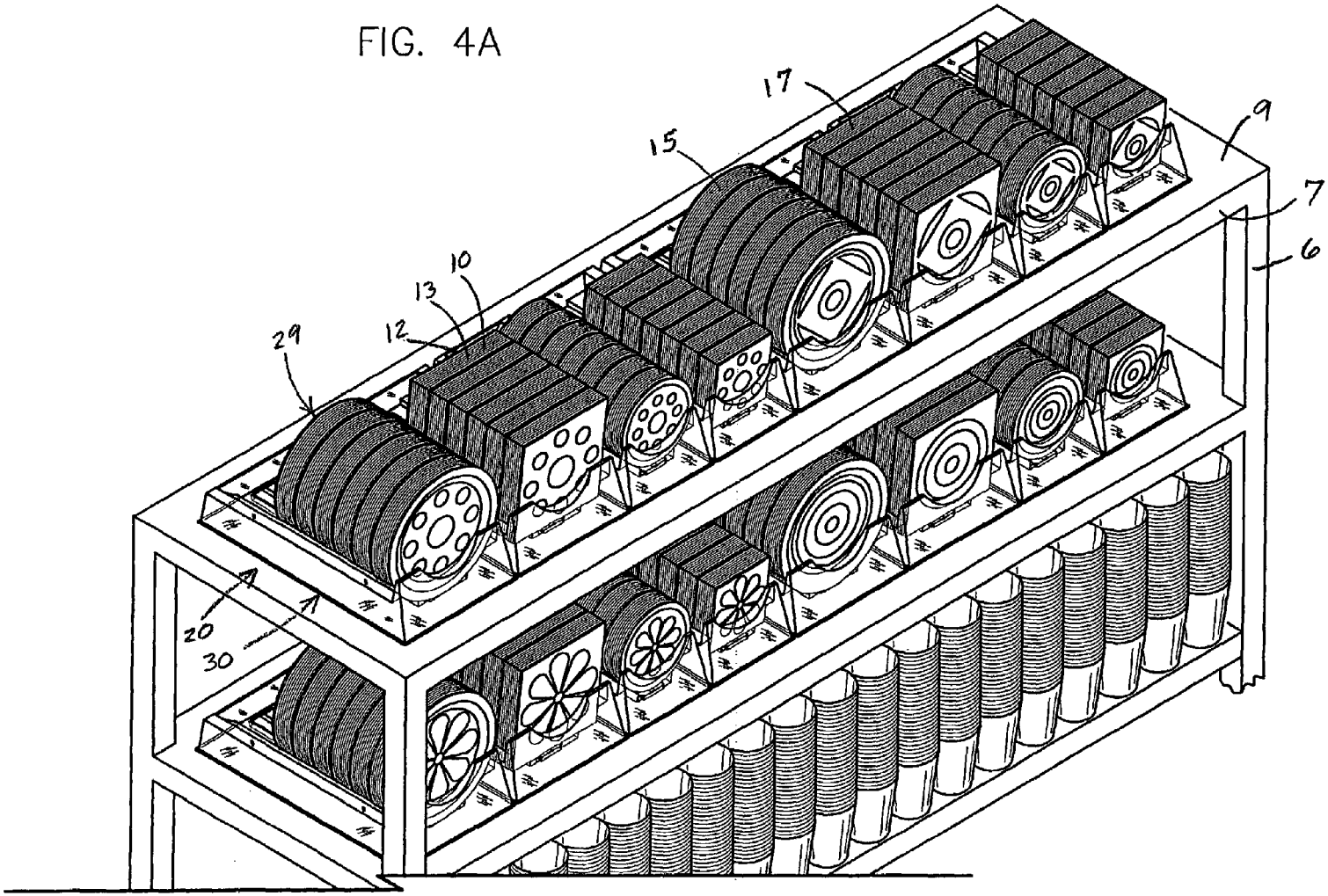
FIG. 4A is a perspective view of the view of a smaller number of display dispensers for a smaller assortment of packaged plates and napkins arranged on the shelving of a store in an organized, compact and shoppable manner so that the required shelving space for this assortment is minimized.
Figure 4B:
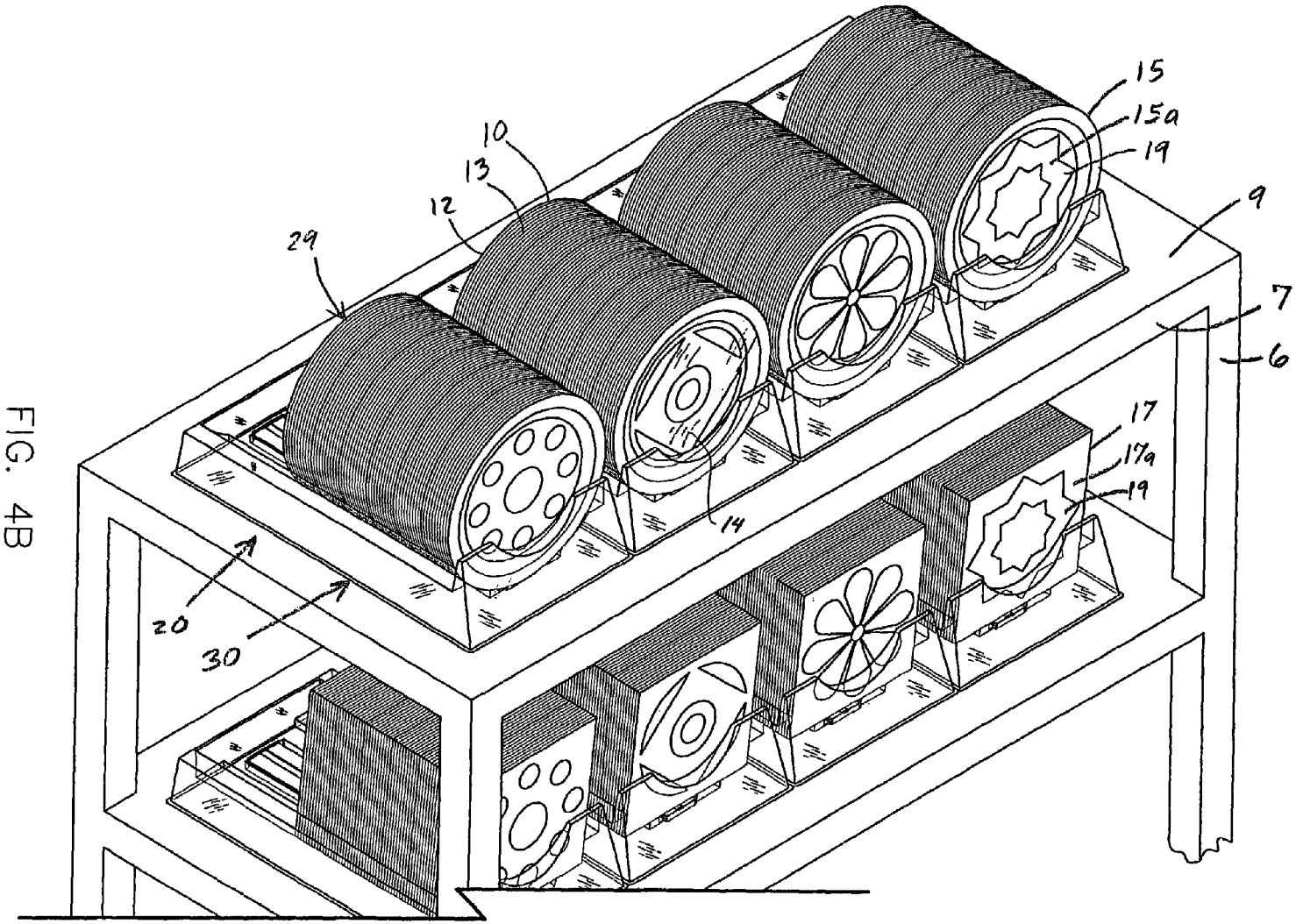
FIG. 4B is an enlarged perspective view of the an even smaller number of display dispensers for an even smaller assortment of packaged plates and napkins arranged on the shelving of a store in an organized, compact and shoppable manner so that the required shelving space for this assortment is even further minimized.

The display dispenser 20 includes a tray 30 having a main body 31 with a unibody construction that is molded or otherwise formed by a single thin sheet of material 31 a. The tray 30 has a rectangular shape with an outer perimeter 32 with four outer corners 35 that define the side margins of the tray when viewed from above. The tray 20 also forms a rectangular shaped interior pocket with four inner corners 36 as discussed below. The perimeter 32 preferably encompasses the side margins of the packages 10 when they are placed on the tray as best shown in FIGS. 4A and 4B. The sides 13 of the packages 10 on adjacent abutting display dispensers 20 remain slightly spaced apart so that the columns of packages do not engage each other and become jammed. The tray 30 is preferably molded by a conventional molding process using a plastic material such as polyethylene terephthalate. The tray 30 is structurally sturdy so as to retain its shape when supporting a number of packages 10 of paper plates 15 or paper napkins 17. The molded sheet 31*a* has a substantially uniform thickness throughout the entire extent of the tray 30 and is preferably continuous and unbroken. The sheet 31*a* preferably has a thickness in the range of about 0.03 to 0.04 inches.

Much of the structural strength and stability of the tray 30 comes from a double-walled structure 40 that extends around its perimeter 32. The double-walled structure 40 is preferably a continuous unbroken structure that extends completely around the tray 30, and is formed by an inner and outer shells 41 and 42. The inner shell 41 is integrally joined to the outer shell 42 along a top portion or ridge 44 that extends around the perimeter 32 of the tray 30. The ridge 44 is generally flat between its parallel molded edges. The width of the ridge 44 is relatively narrow so that its molded edges give the top of the tray 30 a desired degree of structural rigidity. The shells 41 and 42 are preferably integrally molded together in a continuous and unbroken manner along the top portion 44 of the entire double-walled structure 40. The shells 41 and 42 are also spaced apart to form a V-shape that gives the double-walled structure 40 a hollow core 45. The lower end 47 of the outer shell 42 has an outwardly extending rim 48. Both the hollow core 45 and rim 48 extend completely around the double-walled structure 40 in an unbroken manner. The lower end 47 of the outer shell 42 forms a plane. The rim 48 is preferably flat and extends outwardly along that plane. When the tray 30 is placed on a flat planar surface 9 such as a store shelf 7, the planar rim 48 uniformly and flushly engages that surface 9. The rim 48 is substantially perpendicular to a main portion of the outer shell 42 to define a molded edge to provide added strength and stability to the double-wall structure 40.

Figure 5B:
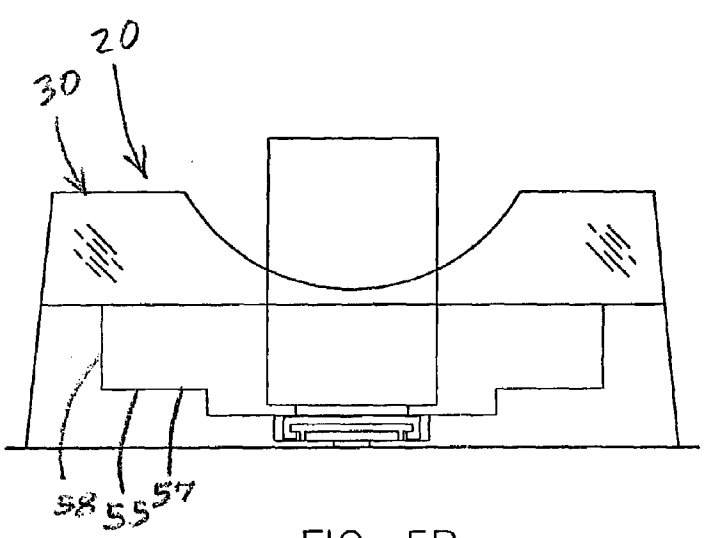
FIG. 5B is a front view of the second embodiment of the display dispenser with squared-off side ledges for holding paper napkins.
Figure 5A:
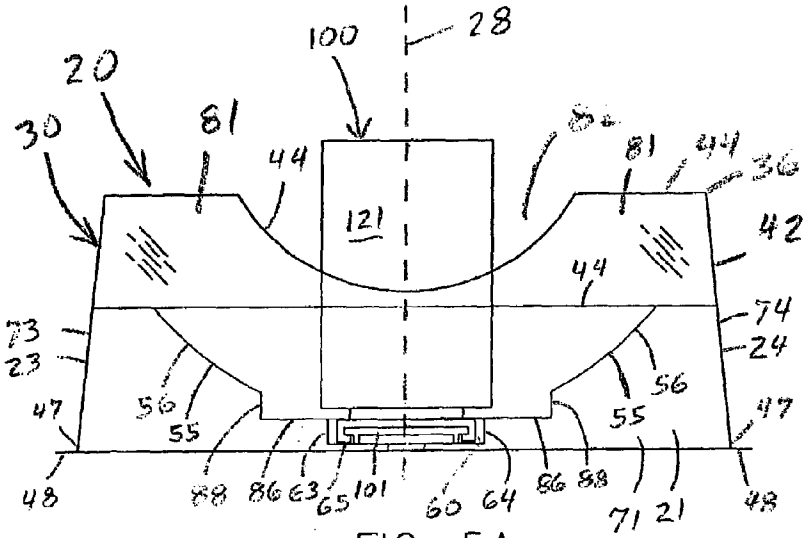
FIG. 5A is a front view of the first embodiment of the display dispenser with arcuate side ledges for holding paper plates.
Figure 6:
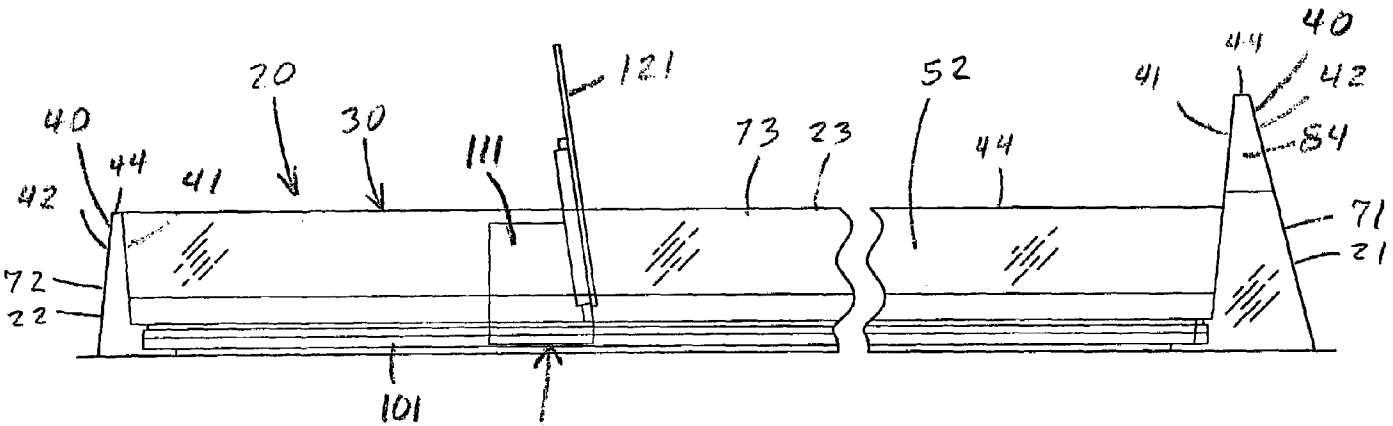
FIG. 6 is a side view of the display dispenser.
Figure 7:
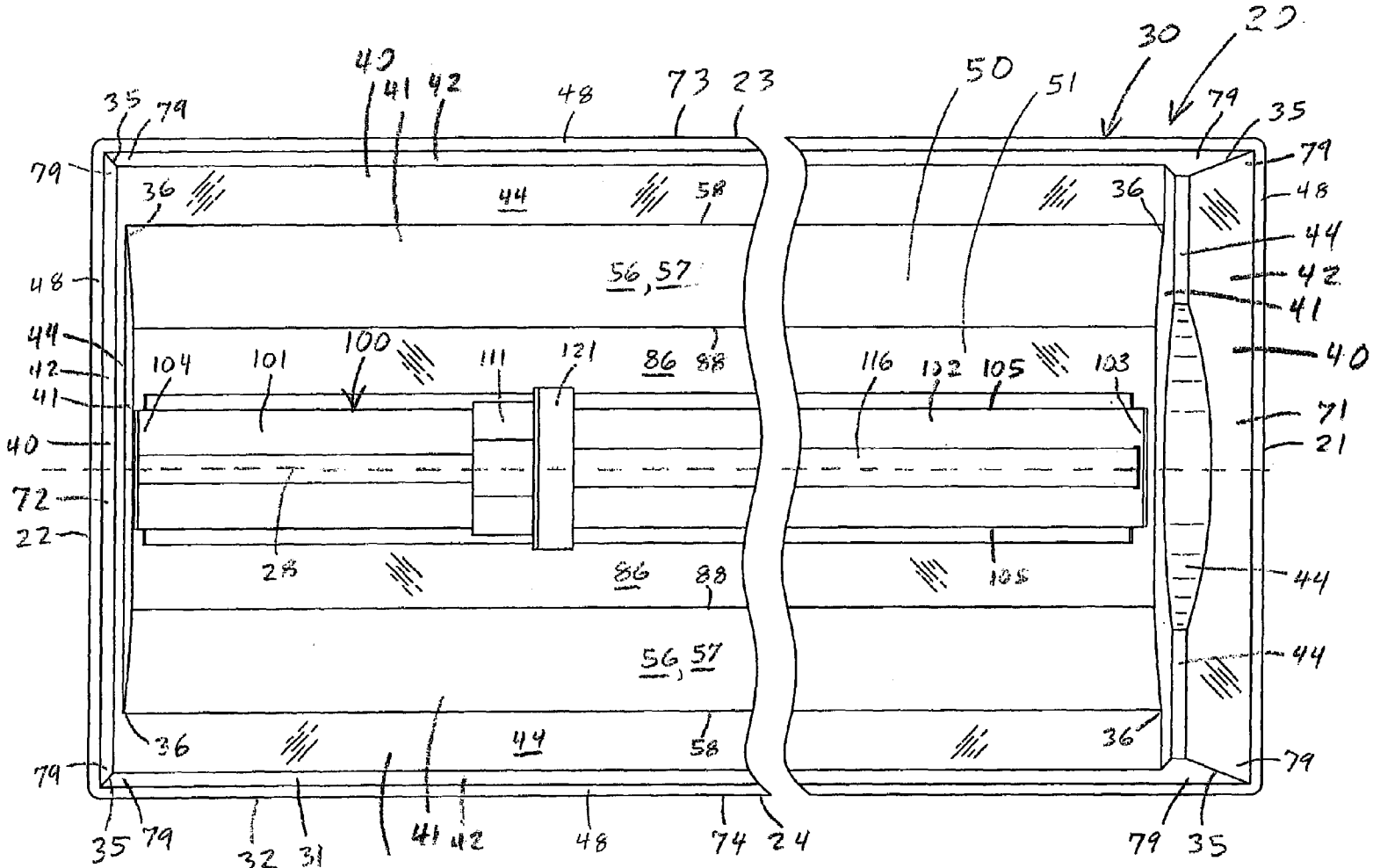
FIG. 7 is a top plan view of the display dispenser.

The inner shell 41 forms an interior portion 50 of the tray 30. The interior portion 50 includes the inner half of the double-walled structure 40 and a lower portion 51 extending between the double-walled structure. The lower portion 51 extends continuously from front to rear and from side to side along its full extent without interruption. The double-walled structure 40 and the lower portion 51 form a pocket 52 for receiving and holding the packages 10 of paper plates 15 or napkins 17. The inner shell 41 includes a pair of opposed side ledges 55 that engage the sides 13 of the packages 10. Each ledge 55 extends along one of the sides 23 and 24 of the double-walled structure 40 from about the front 21 to about the rear 22 of the display 20. In one embodiment of the tray 30, each ledge 55 takes the form of an arcuate surface 56 with a radius or diameter equal to that of the paper plates 15 it is designed to hold as best shown in FIGS. 3A and 5A. The spaced arcuate surfaces 56 share a common origin so that the sides 13 of the packages 10 of round plates 15 flushly engage and rest of the arcuate surfaces in a uniformly aligned or queued manner along the length or depth of the tray 30. In a second embodiment, the ledges 55 are formed by a substantially horizontal surface 57 and a substantially vertical surface 58, as best shown in FIGS. 3B and 5B. The sides 13 of the packages 10 of paper napkins 17 flushly engage and rest on horizontal surfaces 57. The vertical surfaces 58 are spaced apart an amount substantially equal to the width of the napkins, and uniformly align each of the packages 10 in a queued manner along the length of the tray 30. The sides 13 of the packages 10 of plates 15 are contained within the outer margin 32 of the tray 30, and do not extend beyond the outer shell 42 of the tray 30. Individual display dispensers 20 are arranged in an abutting side-by-side arrangement, as shown in FIGS. 2, 4A and 4B.

A recess 60 is formed into the lower portion 51 of the interior portion 50 of the tray 30. The recess 60 has a generally rectangular shape with a front wall 61 located toward the front 21 of the tray 30, a rear wall 62 located toward the rear 22 of the tray, and a pair of sidewalls 63 and 64 that are parallel to and straddle the plain of symmetry 28. Each of the sidewalls 61–64 is joined at its lower end by an integral floor 65. The floor 65 is generally flat and in the same or substantially the same horizontal plane as the rim 48 of the outer shell 42. The floor 65 either directly or indirectly engages and rests on the flat supporting surface 9. The sidewalls 61–64 are substantially vertical and perpendicular to the main body of the lower portion 51 and the floor 65. The upper and lower ends of the sidewalls 61–64 form molded edges that add structural strength to the lower portion 51 and recess 60. Each front and rear wall 61 and 62 of the recess 60 has an elongated and substantially horizontal retaining flange or knob 66 along its upper end as discussed below.

The outer double-walled structure 40 includes a front wall 71, rear wall 72 and sidewalls 73 and 74. Each wall 71–74 includes an inner wall section 75 formed by the inner shell 41. The inner wall section 75 has an inner surface 76. Each wall 71–74 also includes an outer wall section 77 formed by the outer shell 42. The outer wall section 77 has an outer surface 78. The inner and outer wall sections 75 and 77 of each wall 61–64 are integrally molded together along the top portion 44 and uniformly spaced apart so that the cross-sectional shape of its hollow core 45 of each wall forms a uniform V-shape from one end of the wall to the other. Each inner and outer wall section 75 and 77 has two opposed longitudinal ends 79. The outer corners 35 of the outer shell 42 are defined by the longitudinal ends 79 of the outer wall sections 77 of the walls 71–74. The inner corners 36 of the inner shell 41 are defined by the longitudinal ends 79 of the inner wall sections 75 of the walls 71–74. Each corner 35 and 36 forms a molded edge that adds to the structural strength and rigidity of the tray 30.

The front wall 71 has a predetermined height relative to the packages 10 the tray 20 is intended to hold. The front wall 71 preferably has left and right shoulders 81 that straddle a window 82. The window 82 has a center aligned with the plane of symmetry 28 of the tray 20. The lower portion 51 of the tray 30 includes an intermediate ledge or shelf 86. This flat planar shelf 86 spans horizontally between the ledges 55 and the recess 60. Each inner wall section 75 has a vertical spacing wall portion 88 along the side margins of the shelf 86. The spacing wall 88 spaces the shelf 86 and the top or upper edges of the recess 60 from the ledges 55 of the side walls 73 and 74 so that the recess 60 can have its desired depth. The molded edges that define the margins of the flat shelf 86 help stiffen the thin plastic around the recess 60. The floor 65 of the recess 60 is preferably spaced slightly above the plane of the rim 48 to accommodate a magnetic strip 91 secured to the underside of the floor to help secure the display dispenser 20 to the metal surface 9 of the shelf 7.

When the tray 20 is intended to hold packaged stacks of round paper plates 15, the top portion 44 of the window 82 has a somewhat semi-circular shape to give the window a substantially semi-circular shape. When the tray 20 is intended to hold packaged stacks of square paper napkins 15, the top portion 44 of the window has is flat to give the window a square shape. The height of the front wall 71 at the shoulders 81 is preferably less that about half the width or diameter of the packages 10 it is intended to hold so that about half or more of the design 19 on the top 11 of the package extends above the shoulders. For example, trays 20 designed to hold packages of paper plates with a diameter of eight inches or paper plates with a width of eight inches have shoulders 81 that are about three inches and a quarter (3¼) above the intermediate shelf 86 of the tray or four (4) inches above the lower end 47 of the outer wall section 77 of the front wall 71. The window 82 is about half the height of the shoulders 81 so that all or a majority of the central portion 15*b* or 17*b* of the plate 15 or napkin 17 and its design 19 is visible. Only the rim 15*c* or border 17*c* of the napkin 17 engage and are obstructed by the front wall 71.

Figure 8:
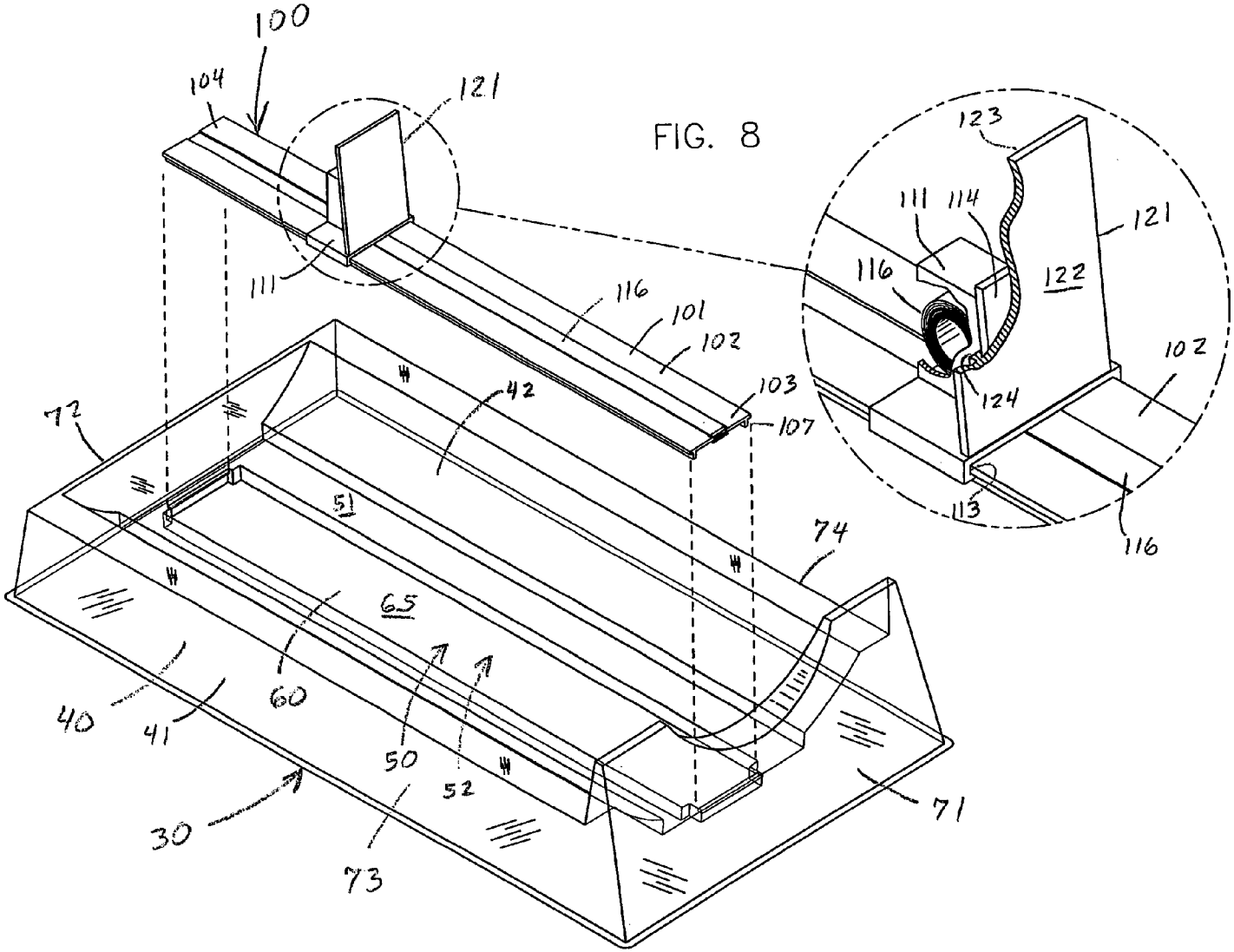
FIG. 8 is an exploded perspective view of the display dispenser with an enlarged cut away view of the unified pusher mechanism.

The display dispenser 20 has a conventional pusher assembly 100 that is snuggly received in the recess 60 of the tray 30. The pusher assembly 100 has several components that form a unified assembly that does not require it to be secured to the tray 30 to retain its integrity as best shown in FIG. 8. The pusher assembly 100 has a support rail 101 that is received by and secured in the recess 60. The support rail or pusher support 101 has a frame 102 with front and rear ends 103 and 104. The frame 102 defines a rail 105. The sides of the rail 105 are spaced from the side walls 63 and 64 of the recess 60 and are free from obstruction along the length of the rail. The underside of the frame 102 also includes a positioning flange 107 along its length. The positioning flange 107 engages the floor 65 of the recess 60 and positions the support rail parallel to the floor 65 of the recess 60 and surface of the lower portion 51 of the tray 30.

Figure 9:
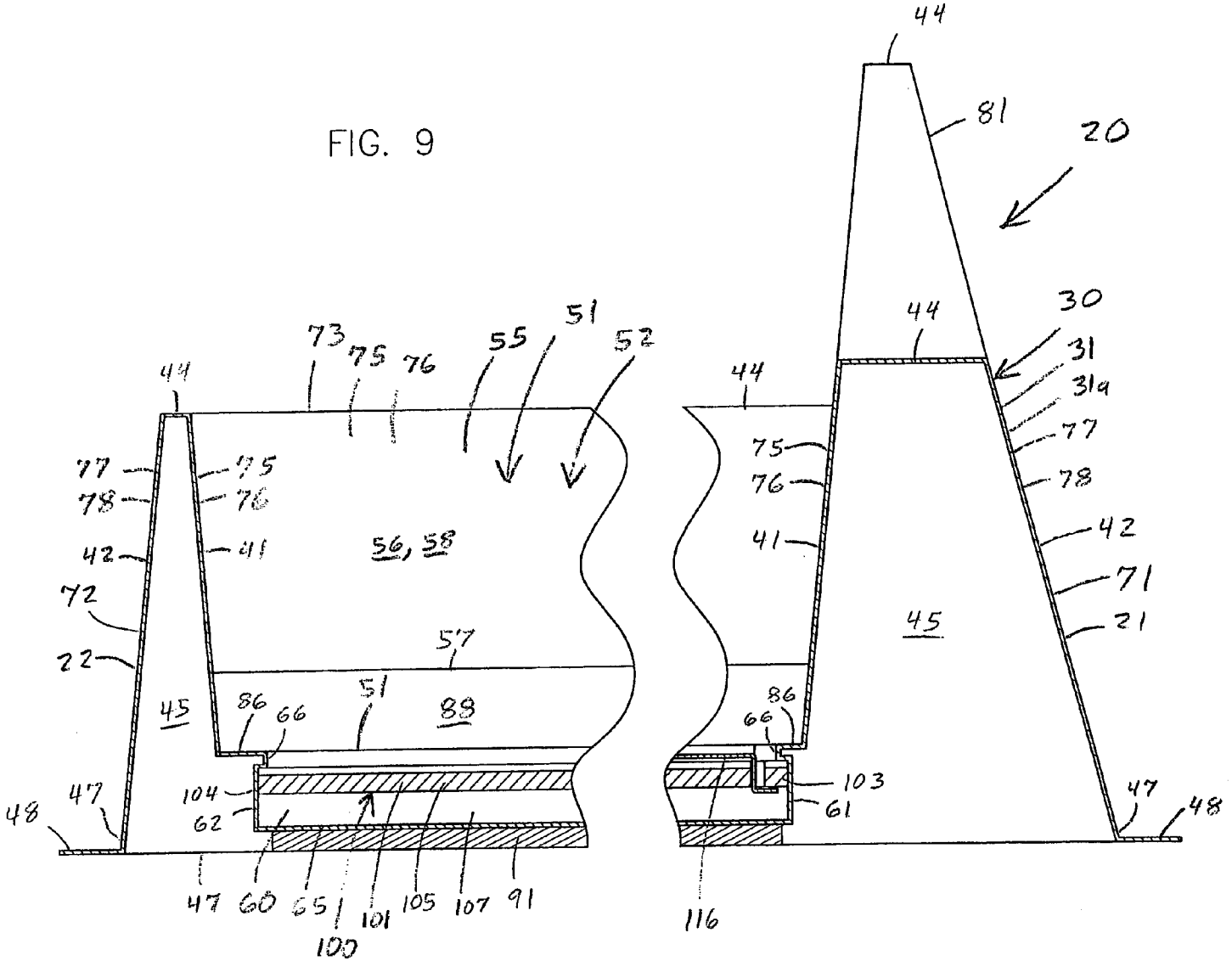
FIG. 9 is an enlarged side view of the front and rear portions of the display dispenser showing the retaining knobs of the unibody tray that provide the snap fit joints to secure the pusher assembly in place.

The pusher assembly 100 and its support rail 101 snap fit into and out of the recess 60 of the tray 30. The length of the support rail 101 is substantially the same as the length of the recess 60. The ends 103 and 104 of the rail 101 are snuggly received between front and rear walls 61 and 62 of the recess 60. Each retaining knob 66 protrudes into the recess about 1/16 of an inch, so that the distance between the retaining knobs is slightly less than the length of the support rail 101 as best shown in FIG. 9. When secured to the tray 30, the rail 101 is received in the recess 60 so that its upper surface just clears the retaining knobs 66. The knobs 66 engage the upper surface of the rail 101 to hold it in place. During the insertion or removal of the rigid support rail 101, the support rail compresses the thin walled, deformable knobs 66 into a deformed compressed position so that the rail can move into or out of the recess 60. The thin plastic sheet 31 forming the unibody tray 30 and its deformable knobs 66 has a desired degree of memory so that the knobs are biased to return to their original molded shape or inwardly extending position. The deformability and biased extended shape of the retaining knobs 66 allows the support rail 101 and pusher assembly to be easily snap fit into and out of the recess 60 of the tray 30.

The pusher assembly 100 includes a glide 111 mounted to the support rail 101. The glide 111 has a main body with a pair of downwardly and inwardly extending arms 112 that form a lower slot 113. The slot 113 is shaped to snuggly and slidingly receive the rail 105 of the rigid pusher support 101. The glide 111 is free to move along the unobstructed length of the rail 105 from near one end 103 to the other 104. The main body of the glide 111 includes an upwardly extending post 114 and a housing that encloses a biasing mechanism such as a coil or helical spring 116. The spring 116 is a metal strip formed into the shape of a coil. The spring 116 is biased to return to its coiled shape when it is unwound. The spring 116 has a coiled portion located on a rear side of the plate 114 and an outer or unwound end that passes through an upper slot in the glide and is firmly secured to the slide rail 101 near its front end 103. The coil spring 116 unwinds as the glide 111 slides along the rail 105 toward its rear end 104. Securing the fixed end of the spring 116 to the slide rail 101 causes an outer surface of the coiled portion of the spring to press against the rear surface of the post 114 when the glide 111 is moved rearward and the spring is unwound. The spring 116 wants to roll back up into its original coiled shape. In this way, the unwound spring 116 biases the glide 111 forward toward the front end 103 of the rail 101 and the front wall 71 of the tray 30. The spring 116 is sized to produce sufficient force to move the intended column of packaged goods 10 placed in the tray toward the front wall 71 of the tray 30.

A pusher plate 121 is firmly secured to the post 114 of the glide 111. The pusher plate 121 has front and rear surfaces 122 and 123 that are substantially perpendicular to the slide rail 101 and the ledges 55 of the tray 30, and are substantially parallel to the inside surface 76 of the inner section 75 of the front wall 71. The front 122 of the plate 121 engages the bottom surface of the rearmost package 10 in the column of packages placed on the tray 30. The rear 123 of the plate 121 has a pair of arms 124 that form a slot that snuggly but slidingly receives the post 114 of the glide 111. Although the pusher plate 121 is firmly secured to the post 114, with enough force it can be slide off the post 114 and removed from the rest of the pusher assembly 100 if desired. The pusher assembly 100 forms a unified assembly or working unit that retains its assembled integrity when secured to or removed from the tray 30. The pusher assembly 100 does not need to be disassembled or reassembled to attach it to or remove it from its securement to the tray 30.

Figure 10:
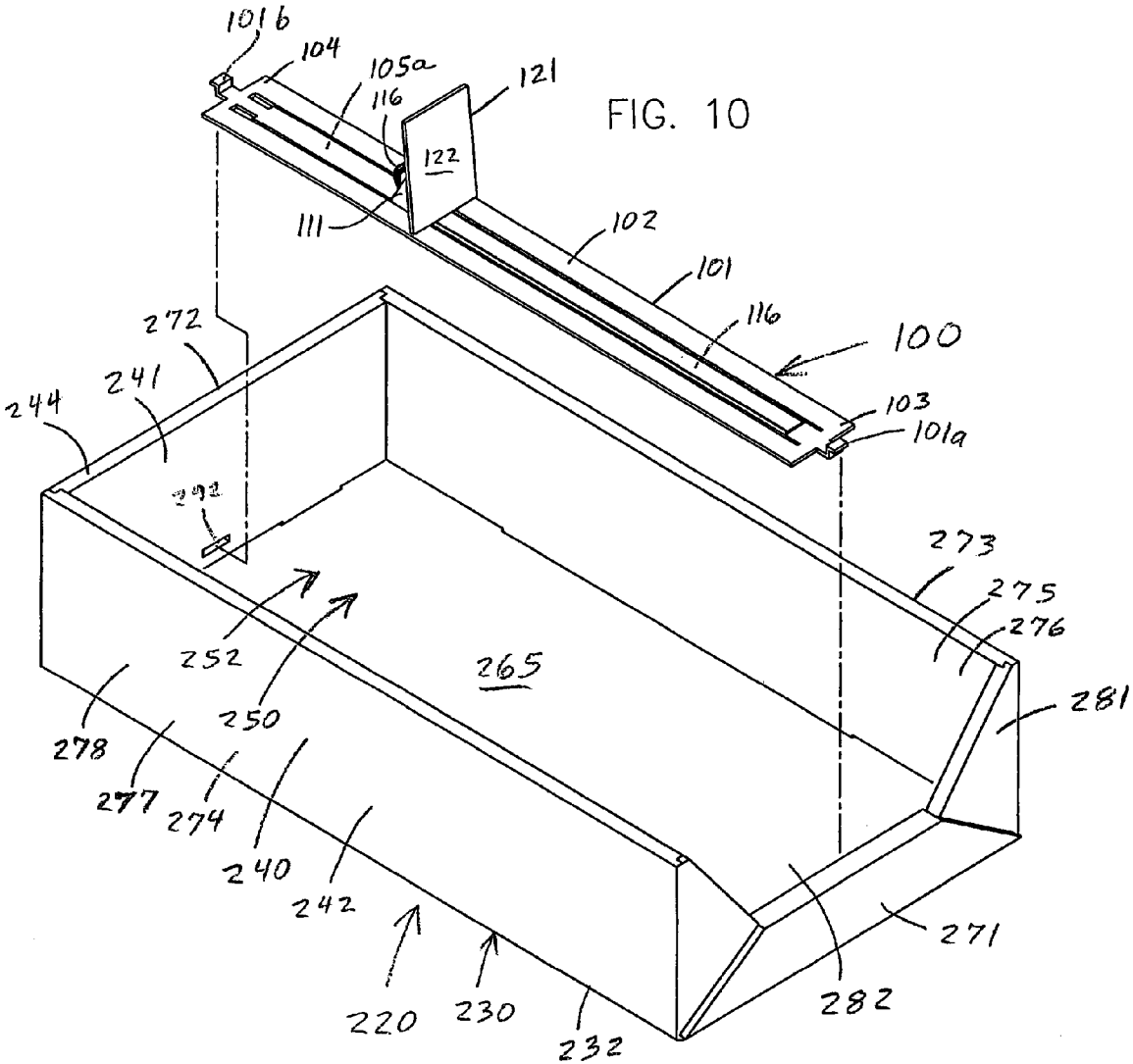
FIG. 10 is a perspective view of a third embodiment of the display dispenser invention having a unibody, corrugated tray and a unified, snap-in pusher assembly.
Figure 11:
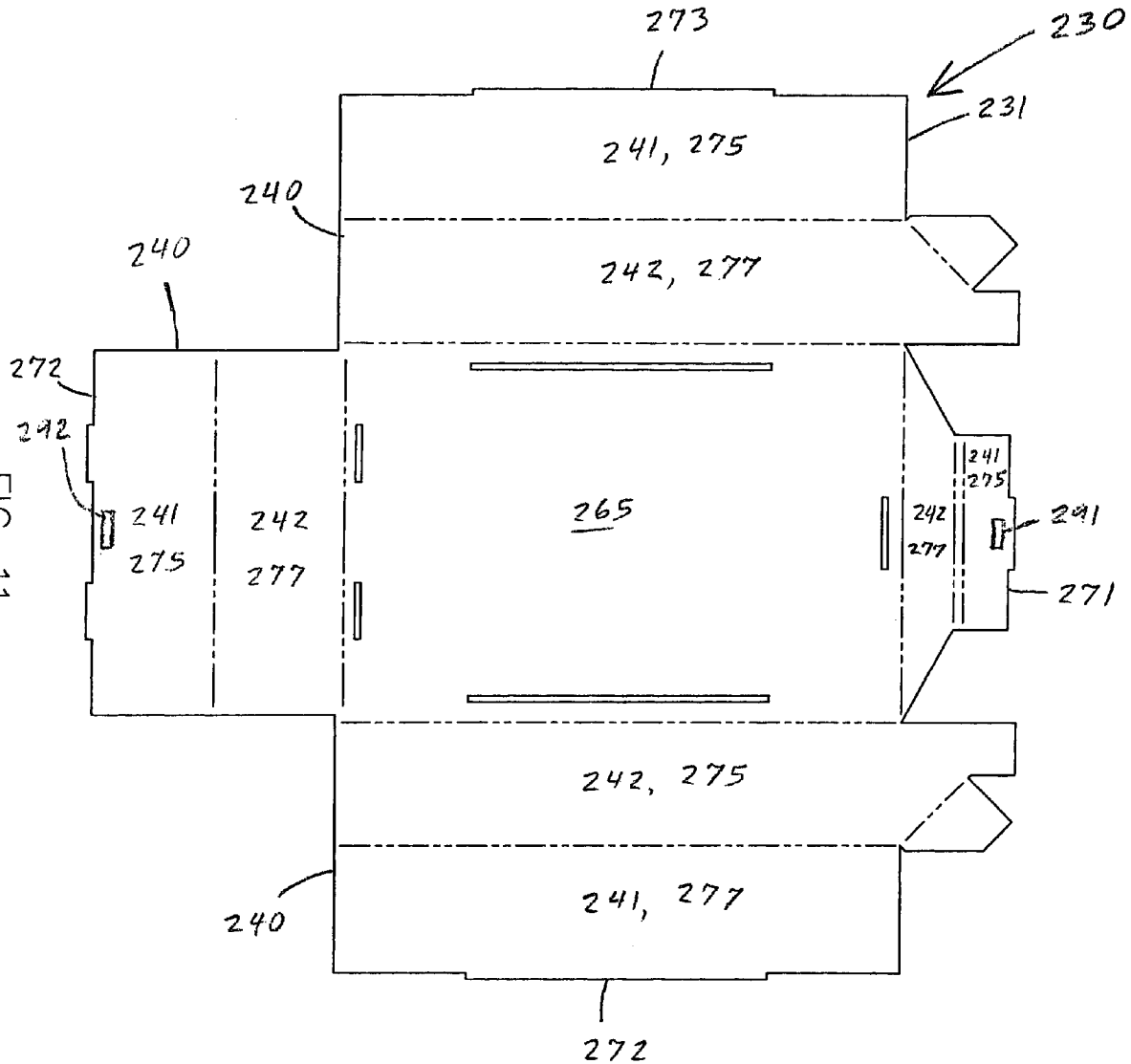
FIG. 11 is a perspective view of a single, corrugated sheet before it is folded to form the unibody, corrugated tray.

FIGS. 10 and 11 show a cardboard version of the dispenser display 220 with a plane of symmetry 225. This display dispenser 220 has a unibody tray 230 that is formed from a single folded sheet 231 of conventional corrugated cardboard. The sheet 231 is folded so that the outer perimeter 232 of the tray 230 is defined by an outer double wall structure 240. An inner wall 241 is joined to the outer wall 242 along a top portion 244. An interior portion 250 combines with the double walled structure 240 to form a pocket 252 for receiving the packages 10 of paper plates 15 or napkins 17. The interior portion forms a floor 265 for supporting the packages 10. The tray 230 has front 271, rear 272 and side walls 273 and 274. The inner wall 241 has inner wall sections 275 with inner surfaces 276, and the outer wall 242 has outer wall sections 277 with outer surfaces 278. The front wall 271 has shoulders 281 that define a window 282. The front wall 271 includes a central slot 291 along the floor 265, and the rear wall 272 includes a central slot 292 along the floor. The dispenser display 220 includes a pusher assembly 100 with a slightly modified pusher support 101. The frame 102 of the support 101 has a central rail 105*a* that is spaced from the frame along its length and is connected to the frame at the front and rear ends 103 and 104 of the support. The pusher support 101 has a first outwardly projecting tab 101*a* extending from its front end 103, and a second outwardly projecting tab 101*b* extending from its rear end 104. Tabs 101*a* and 101*b* are received into slots 291 and 292 respectively to secure the pusher assembly 100 to the cardboard tray 230.

Operation of Dispenser Displays During Use

Although the method of using the display dispenser 20 should be readily understood base on the above, the following discussion is provided to assist the reader. Although the operation of the display dispenser 20 is discussed in conjunction with packages 10 of paper plates 15 and napkins 17, it should be understood that the broad aspect of the invention applies to a wide variety of products, and is not limited to grocery and retail store applications. Stores periodically order and receive shipments of packaged plates 15 and napkins 17. These shipments usually include an assortment of packages 10 of round paper plates 15 and square or rectangular paper napkins with an artistic design 19 on their top surface 15*a* or 17*a*. Each package 10 contains a stack of plates or napkins that are stacked one atop the other. These stacks of goods are packaged by a transparent wrapper 14 so that the design 19 on the top surface of the plate 15 or napkin 17 showing through the packaging. The packages 10 of plates 15 and napkins have round or square side walls 13 with a predetermined height and diameter or width. The diameter or width of the article 15 or 17 is usually larger than its height, particularly for specialty plates and napkins.

The paper plates 15 and napkins 17 are shipped in boxes containing one or more display dispensers 20 and one or more types of packages 10. The manufacturer matches the display dispensers 20 with the appropriate packaged product 10. Each box includes a number of packages 10 and display dispensers with side ledges 55 that match or will flushly engage the side wall 13 of those packages. Each display dispenser 20 is filled or stocked with an appropriate number of packages 10, or the trays 30 and pusher assemblies 100 can be stacked separately from the packages for assembly and loading by store workers. One of the like-shaped pusher assemblies 100 is inserted into the like-shaped recess 60 of each tray 30. The support rail 101 snap fits beneath the retaining knobs 66 of the recess 60 so that the knobs extend out over the top surface of the rail to secure it to the tray 30.

If not already done by the manufacturer, an appropriate number of packages 10 are loaded into the tray 30 of each assembled dispenser 20 in a column or queued manner 29. The glide 111 and pusher plate 121 of the pusher assembly 100 are cocked or moved back toward the rear wall 72 of the tray 30 to unwind the spring 116 into its activated condition. The packages 10 are then placed between the pusher plate 121 and the front wall 71 of the tray 30. The arcuate or squared off ledges 55 of each tray 30 flushly engage and support the round or square side walls 13 of the paper plates 15 or paper napkins 17. The pusher plate 121 is released and biased by the spring 116 to engage the rear surface of the rearmost package in the column of loaded packages 10. The pusher assembly 100 and unwound spring 116 then push the queued packages 29 toward the front wall 71. The frontmost package 10 is pressed against the inside surface 76 of the front wall 71 so that the center portion of its design 19 is located in the window 82 between said shoulders 81 of the front wall 71. The design 19 on the top surface 15*a* or 17*a* of the top paper plate 15 or napkin 17 in the frontmost package is substantially vertical or parallel to the front wall 71 of the tray 30.

The loaded display dispensers 20 are then placed on the desired shelf or shelves 7 of the shelving unit 6. The front wall 71 of the tray and the design 19 on the frontmost package 10 is substantially perpendicular to the aisle 5 so that the design faces the aisle and is in the visible line of sight of the customers no mater what the height of its shelf 7. The individual display dispensers 20 are placed in a row on each shelve 7 so that each is right along the side of its adjacent display dispensers on that shelf. The side walls 73 and 74 of the adjacent display dispensers 20 preferably butt up against and engage each other.

The shelving unit 6 contains an assortment of matched sets of packaged paper plates 15 and napkins 17. The display dispensers 20 can be arranged so that matched sets of packaged paper plates 15 and napkins 17 are next to each other as in FIGS. 2 and 4A, or the display dispensers can be arranged so that the matched sets are immediately above or below each other on adjacent shelves 7 as in FIG. 4B. When the assortment of packaged paper plates 15 and napkins 17 is depleted as the more popular designs are purchased, the staff can easily rearrange the filled or partially filled dispenser displays 20 into a more compact area such as by placing the remaining assortment on a more limited number of shelves 7 as in FIG. 4A, or by placing the remaining assortment on a smaller shelving unit 6 as in FIG. 4B. When a new shipment is received, the replenished assortment can be easily expanded to fill a larger shelving unit 6. In each instance, the staff can organize the display dispensers 20 into an organized manner so that customers can easily see and shop the entire assortment and identify matched sets.

While the invention has been described with reference to a preferred embodiment, it will be understood by those skilled in the art that various changes may be made and equivalents may be substituted without departing from the broad aspects of the invention.

I claim:

1. A method of displaying and dispensing packages of round paper plates on a shelf of a store with an aisle along which customers walk, the method comprising the steps of:

providing a plurality of packages, each of said packages containing a stack of paper plates including a top plate, each of said plates having an artistic design on its top surface, each of said package including a transparent wrapper to package its stack of paper plates, said design on said top surface of said top plate showing through said wrapper, said package having a round side wall with a predetermined height, and said package having a diameter larger than its height;

providing a display dispenser with a tray and a pusher assembly, said tray having a unibody construction formed by a thin sheet with a front wall and opposed arcuate side ledges, said pusher assembly having a pusher plate biased toward said front wall, and said front wall having an arcuate window formed between a pair of opposed shoulders;

loading said plurality of packages into said tray in a queued manner to form a stocked display, said opposed arcuate ledges of said tray supporting said round side wall of each of said packages, each of said packages being placed between said pusher plate and said front wall of said tray;

allowing said display dispenser to push said queued packages toward said front wall and aligning a frontmost package with said front wall with its said design located in said window between said shoulders of said display; and, placing said stocked display dispenser on the shelf of the store, said design on said top plate of said frontmost package facing toward the aisle and being in a visible line of sight of the customers independent of the height of the shelf.

2. The method of displaying and dispensing packages of claim 1, and wherein each of said plates has a central area having a given radius, and said design is located in said central area, and said window has a radius that is one of either substantially equal to or larger than said radius of said central area of said plates, and said design of said frontmost package is substantially entirely in said visible line of sight of the customer.

3. A method of displaying, dispensing and organizing matched sets of packages of round paper plates and square paper napkins placed on a shelf of a store having an aisle along which customers walk, said method comprising the steps of:

providing a plurality of separate and distinct plate display dispensers and a plurality of separate and distinct napkin display dispensers, each display dispenser having a tray with a thin unibody construction with a front wall and a unified pusher assembly having a pusher plate biased toward said front wall, each plate display dispenser having opposed arcuate side ledges and said front wall having a top with an arcuate window formed between a pair of opposed shoulders, and each napkin display dispenser having opposed side ledges, and said front wall having a top with a window formed between a pair of opposed shoulders;

providing a first matched set of packages of round paper plates and square paper napkins, each plate and napkin in said first matched set having a top surface with a first design;

providing a second matched set of packages of round paper plates and square paper napkins, each plate and napkin in said second matched set having a top surface with a second design, each package having an outer transparent wrapper, said design on said top surface of said plates and napkins showing through said wrapper, each of said packages having a side wall of a predetermined height, and said height being smaller than one of either said diameter and width of said package;

stocking each of said display dispensers with one of either said packages of round paper plates and said packages of square paper napkins, each of said display dispensers having packages with one of either said first design and said second design, said opposed arcuate ledges of said plate display dispensers supporting said round side wall of said packages of paper plates, said opposed ledges of said napkin display dispensers supporting said flat side wall of each package of paper napkins, each of said packages being placed between said pusher plate and said front wall of said display dispenser; and, placing said stocked display dispensers on the shelf of the store, each matched set being in one of either a side-by-side arrangement and a one-above-the other arrangement, said design of said frontmost package facing toward the aisle and being in a visible line of sight of the customers independent of the height of the shelf upon which said stacked display dispensers are placed.

4. The method of claim 3, and wherein said design is one of a single color and a multi-colored artistic design.

5. A method of displaying, dispensing and organizing matched sets of packages of round paper plates and square paper napkins placed on a shelf of a store having an aisle along which customers walk, said method comprising the steps of:

providing a plurality of separate and distinct trays, each tray having a unibody construction with a front wall and at least one recess;

providing a plurality if unified pusher assemblies having a pusher support, a pusher plate and a biasing mechanism;

providing a first matched set of packages of paper plates and paper napkins, each plate and napkin in said first matched set having a top surface with a first corresponding design;

providing a second matched set of packages of paper plates and paper napkins, each plate and napkin in said second matched set having a top surface with a second corresponding design, each package having an outer transparent wrapper, said design on said top surface of said plates and napkins showing through said wrapper;

installing one of said unified pusher assemblies into each of said trays to form a display dispenser, said pusher support being securably received in said at least one recess, and said biasing mechanism biasing its said pusher plate toward said front wall;

stocking each of said display dispensers with one of either said packages of paper plates and said packages of paper napkins, each of said display dispensers having packages with one of either said first design and said second design, each of said packages being placed between said pusher plate and said front wall of said display dispenser; and, placing said stocked display dispensers on the shelf of the store, each matched set being in one of either a side-by-side arrangement and a one-above-the other arrangement, said design of said frontmost package of each said stocked display dispenser facing toward the aisle and being in a visible line of sight of the customers independent of the height of the shelf upon which said stacked display dispensers are placed;

removing each of said display dispensers when its said packages have been depleted;

separating said pusher assembly from said tray of said depleted display dispenser; and, discarding said tray of said depleted display dispenser.

6. The method of claim 5, and wherein said packages of paper plates are round and said packages of paper napkins are square, and said trays are one of either plate trays and napkin trays, said plate trays being used to form separate and distinct plate display dispensers and said napkin trays being used to form separate and distinct napkin display dispensers, each plate display dispenser having opposed arcuate side ledges, and each napkin display dispenser having opposed flat side ledges, said opposed arcuate side ledges of said plate display dispensers supporting said round side wall of said round packages of paper plates, said opposed flat side ledges of said napkin display dispensers supporting said flat side wall of each package of paper napkins.

* * * * *